US007251841B2

(12) United States Patent
Corsini

(10) Patent No.: US 7,251,841 B2
(45) Date of Patent: Aug. 7, 2007

(54) INTEGRATED FACEMASK FIREFIGHTING HOOD PACKING SYSTEM

(75) Inventor: Ralph Corsini, 5 Mackay Rd., Bay Shore, NY (US) 11706

(73) Assignee: Ralph Corsini, Bay Shore, NY (US)

( * ) Notice: Subject to any disclaimer, the term of this patent is extended or adjusted under 35 U.S.C. 154(b) by 0 days.

(21) Appl. No.: 10/684,613

(22) Filed: Oct. 14, 2003

(65) Prior Publication Data

US 2004/0107478 A1 Jun. 10, 2004

Related U.S. Application Data

(60) Provisional application No. 60/418,490, filed on Oct. 15, 2002.

(51) Int. Cl.
*A42B 1/08* (2006.01)

(52) U.S. Cl. ..... 2/424; 2/5; 2/205; 128/201.23

(58) Field of Classification Search ..... 2/202, 2/205, 424, 173, 5; 128/201.22, 201.25, 128/201.23, 206.21, 206.27

See application file for complete search history.

(56) References Cited

U.S. PATENT DOCUMENTS

| | | | | |
|---|---|---|---|---|
| 1,930,399 | A * | 10/1933 | Stelzner | 128/201.23 |
| 2,448,021 | A * | 8/1948 | De Grazia | 2/205 |
| 2,835,899 | A * | 5/1958 | Monro et al. | 2/202 |
| 3,605,119 | A * | 9/1971 | Cherry | 2/88 |
| 4,154,235 | A * | 5/1979 | Warncke | 128/201.25 |
| D261,073 | S | 10/1981 | Spuill | |
| 4,473,072 | A * | 9/1984 | Walther | 128/201.25 |
| 4,671,775 | A * | 6/1987 | Hill | 441/124 |
| 4,807,614 | A * | 2/1989 | van der Smissen et al. | 128/201.23 |
| 4,836,197 | A * | 6/1989 | Rohling et al. | 128/201.23 |
| 4,864,654 | A * | 9/1989 | Schriver et al. | 2/84 |
| H863 | H * | 1/1991 | Kwiedorowicz et al. | 2/424 |
| 6,266,828 | B1 | 7/2001 | Corsini | |
| 6,478,025 | B1 | 11/2002 | Yort et al. | |

* cited by examiner

*Primary Examiner*—Rodney M. Lindsey

(57) ABSTRACT

The integrated facemask firefighting hood packing system allows a hood to be packed on a facemask. This system reduces the possibility of a hood being in the way of a user when it is not in use.

4 Claims, 5 Drawing Sheets

INTEGRATED FACEMASK FIREFIGHTING HOOD PACKING SYSTEM

CROSS-REFERENCE TO RELATED APPLICATIONS

This application incorporates by reference utility patent 6,266,828 Integrated Facemask Firefighting Hood issued Jul. 31, 2001 and provisional patent application 60/418,490 Integrated Facemask Firefighting Hood Roll Down Method Oct. 15, 2002.

BACKGROUND OF THE INVENTION

1. Field of the Invention

This invention pertains to the field of safety equipment. Military, Police, Firefighters, Emergency Medical Service, use protective hoods combined with facemasks that protect the head and facilitate breathing in a contaminated environment. The present invention relates to the packing of the hood on the facemask when the protective head gear is not in use.

2. Brief Description of Related Art

To protect the head and neck and facilitate breathing emergency workers, police and military personnel sometimes wear and integrated facemask hood. The hood is mechanically attached to the facemask prior to donning the facemask. Attaching the hood to the facemask prior to donning ensures the interface between the hood and facemask is complete and this configuration also increases the speed at which this safety equipment can be donned. The facemask can be part of a self-contained breathing apparatus (SCBA) which supplies breathing air from a storage container, or the facemask can include a respirator which filters out harmful particulates from the environment to provide safe breathing air. When the integrated facemask and hood are not in use, the hood hangs from the facemask.

This arrangement has a very significant disadvantage. The nature of emergency work most times requires personnel to maneuver into position prior to using the integrated facemask hood. This maneuvering can including crawling through confined spaces, climbing fences, ect. The hood hanging from the facemask causes a snag hazard. The hood can be ripped, disconnected from the facemask, entangled in rescue equipment the worker may be utilizing, easily contaminated and be generally "in the way", thus impeding the progress of the emergency worker and preventing one from successfully completing the objective. Accordingly, a need exists for an integrated facemask hood to be packed in such a way as to reduce the possibility of the hood getting snagged.

SUMMARY OF THE INVENTION

The present invention is directed to packing the integrated hood on the facemask in a secure manner. The integrated hood is attached to the facemask and the hood is rolled or folded in such a way as not to impede the donning of the facemask. It is then secured in its packed position place via an appropriate fastener. The object of the present invention is to reduce the possibility of the integrated hood getting snagged, contaminated, in addition to keeping it out of the way while not being used.

DETAILED DESCRIPTION OF THE INVENTION

As shown in FIG. 1 and FIG. 2, conventional prior art integrated hoods and SCBA are donned by slipping the mask and integrated hood system over ones head, pulling the bib portion downward over the collar and closure of the firefighting jacket. Both prior art FIG. 1 and FIG. 2 have significant disadvantages.

FIG. 1, combining the hood and head net (hood/net). The National Fire Protection Agency (NFPA) has standards on hood construction. The hood must be 18 inches from the crown of the head to the bottom of the neck opening, this requirement is ensure neck protection. An NFPA compliant hood used with the slip over donning method can cause problems with sealing the facemask to the face. The neck portion of the hood is extended to ensure neck protection. This section of the hood has to slip over the head first introducing the possibility of trapping a portion of the hood between the facemask seal and the firefighters face. This can cause the mask to face seal to fail.

FIG. 1, hood/net connected releasably to the facemask introduces the possibility of the hood/net being disconnected accidentally, be it from getting snagged during use or improper installation by a firefighter doing routine maintenance, both actions can result in losing the face to mask seal. In addition this set-up puts the liability of properly reinstalling the hood/net into the hands of the firefighter. The connection that creates the face to mask seal is critical to the proper functioning of the SCBA.

FIG. 1, hood/net connected permanently introduces a problem with decontaminating this set-up properly. The NFPA has standards on laundering and decontamination of Personal Protective Equipment (PPE). To decontaminate a facemask it must be washed in a water bleach mixture. A permanently attached hood would have to be submerged with the facemask in this mixture. Bleach destroys the protective properties of a firefighting hood. Firefighters are exposed to biohazards daily, proper decontamination of PPE is a necessity.

FIG. 1 hood/net concept requires the hood to be stretched to pull the facemask to the face to create the face to mask seal. This requirement stretches the hood, thus removing the air that is trapped in the weave of the hoods material reducing the Thermal Protection Performance rating of the hood.

FIG. 2 depicts an integrated hood with the head portion of the hood disposed over the harness system of the facemask. This relationship allows access to the adjusting buckles of the harness. With this design, the harness of the facemask can be exposed to high heat as experienced in a flashover or explosion. This has caused the harness to fail and allow the facemask to fall away from the member's face, subjecting him to an extremely hostile environment. In addition to the facemask falling away from the members face, the harness crushes the air out of the hood material significantly reducing the hoods thermal protection performance thus introducing the possibility of the member receiving compression burns. A properly donned hood protects the harness from direct exposure to high heat, thus ensuring the critical face to mask seal and allows air to remain trapped in the hood material which is responsible for maintaining the hoods Thermal Protection Performance rating.

U.S. Pat. No. 6,266,828 teaches an integrated hood mechanically attached to a facemask and method for donning the integrated hood. To don the system, the hood is pulled forward over the facemask, turning it inside out, thus covering the sight window. This is called the staged position. When the integrated facemask and hood are needed the facemask is donned directly onto the head and the hood is pulled back over the head, neck and coat collar, thus exposing the sight window. Although this system addresses the draw backs of prior art referenced in FIG. 1 and FIG. 2, the Staged position allows the hood to hang from the facemask creating the possibility of the hood getting snagged as in the case with prior art FIG. 1 and FIG. 2. Accordingly, a need exists for an integrated facemask hood to be packed and fastened in such a way as to reduce the possibility of the hood getting snagged and contaminated.

DETAILED DECRIPTION OF THE INVENTION

Figure 1:
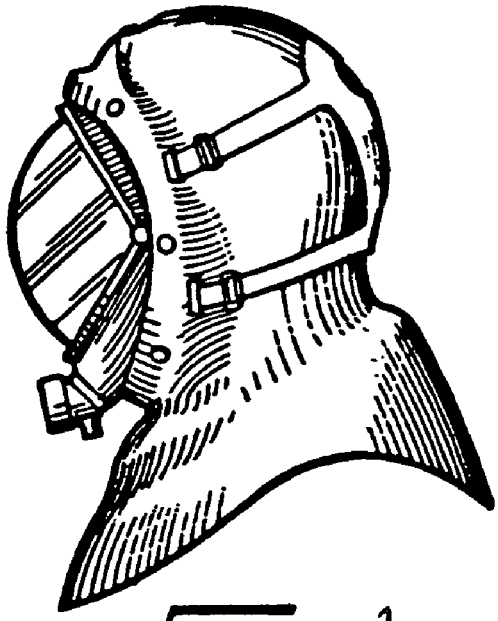
Fig. 1 PRIOR ART
FIG. 1 is a perspective view of a prior art firefighting hood and face mask assembly.
Figure 2:
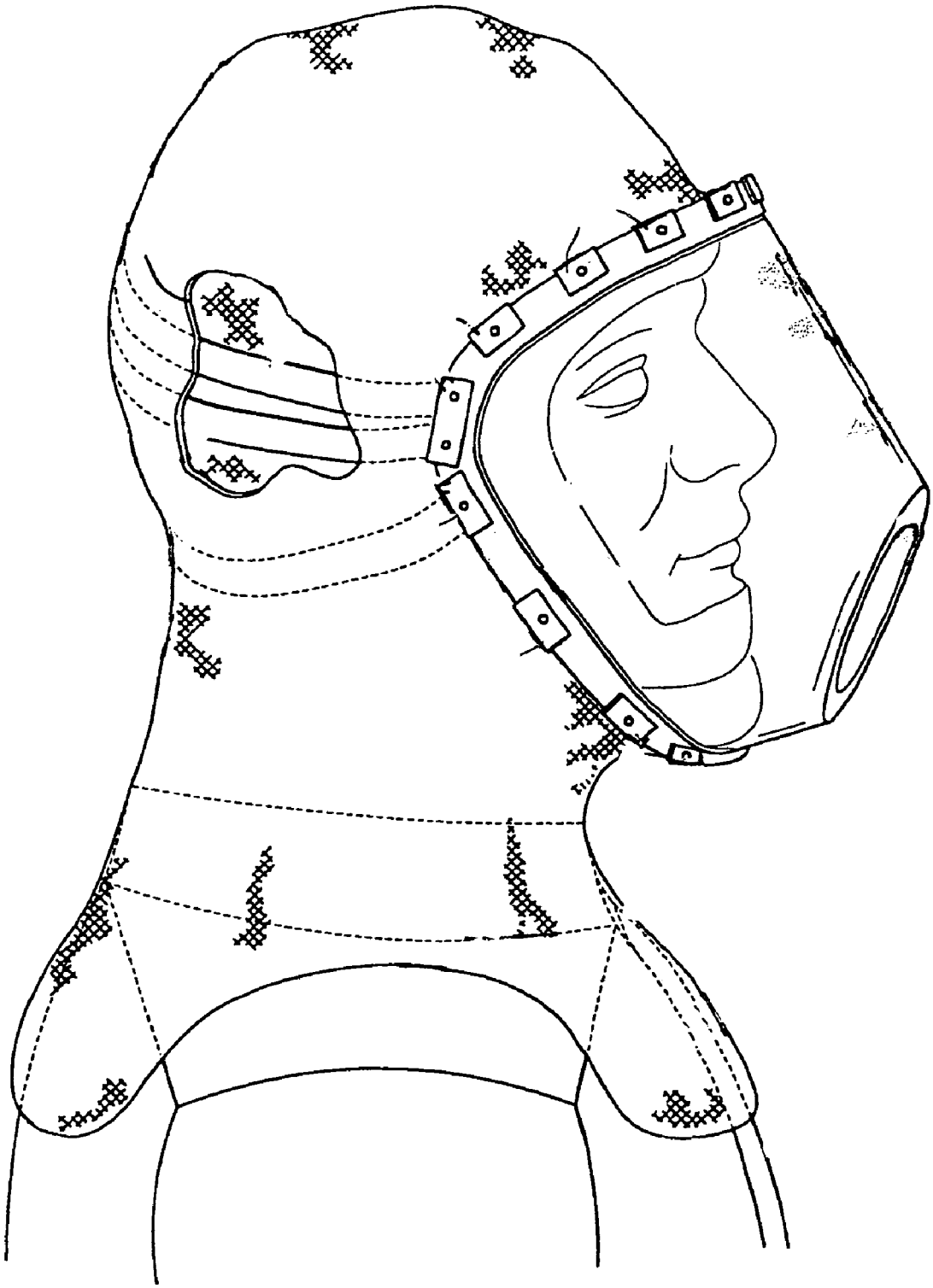
FIG. 2 PRIOR ART
FIG. 2 is a perspective view of a prior art combined fireman's hood and face mask.

Referring now to FIGS. 1 and 2 refer to prior art integrated hoods attached to facemasks but configured differently.

As shown in FIGS. 1 and 2, are conventional integrated hoods without a means for packing the hood.

Figure 5:
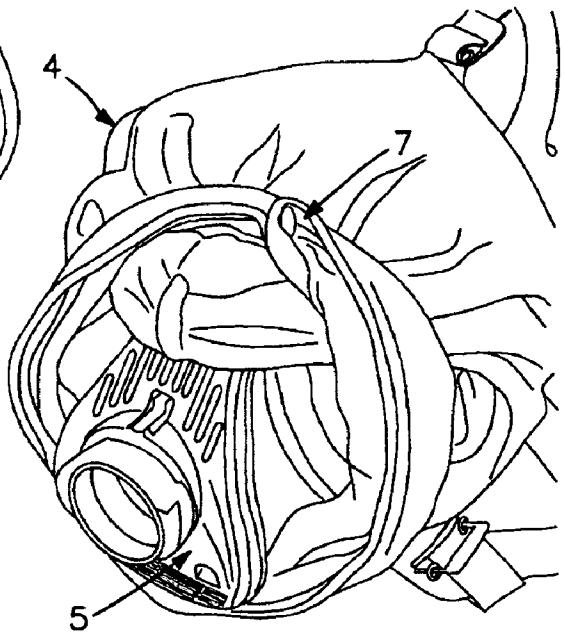
FIGS. 3–8 are perspective views of alternate packing fastener assemblies.
Figure 4:
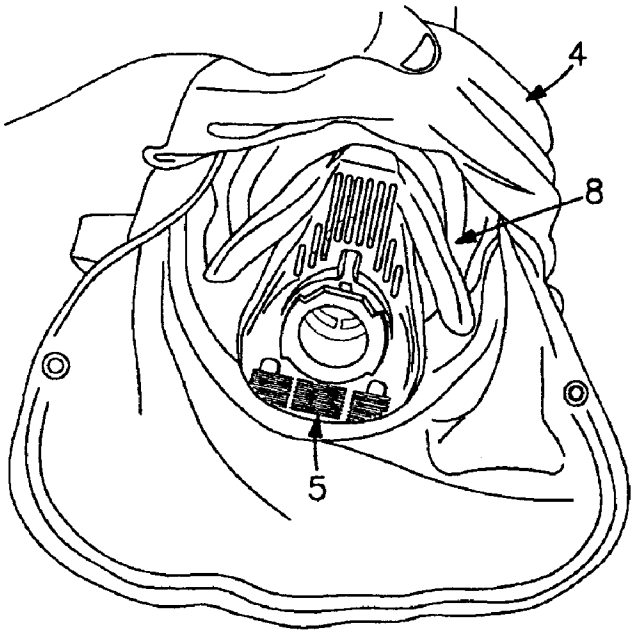
Figure 3:
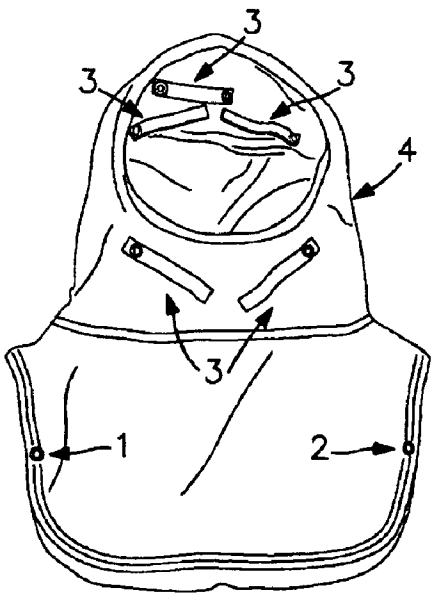

FIGS. 3–5 show and alternate designs for packing an integrated hood.

FIG. 3 shows a male snap stud 1 fastened to an integrated hood 4 with fasteners 3 that are compatible and attachable to a facemask. The female snap socket 2 and male snap stud 1 are compatible.

FIG. 4 shows the integrated hood 4 attached to the facemask 5 with the hood 4 pulled forward over the facemask 5, turning it inside out, thus covering the sight window 8.

FIG. 5 shows the integrated hood 4 attached to the facemask 5 with male snap stud and female snap socket fastened together 7 completing the packing of the integrated hood.

Figure 8:
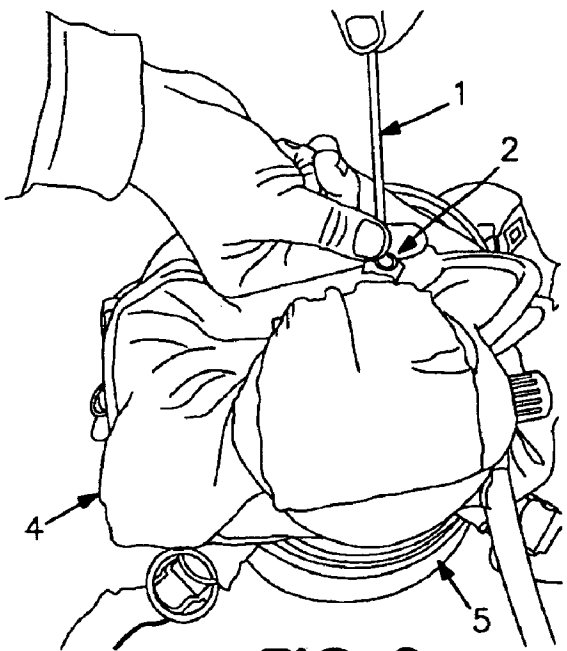
Figure 7:
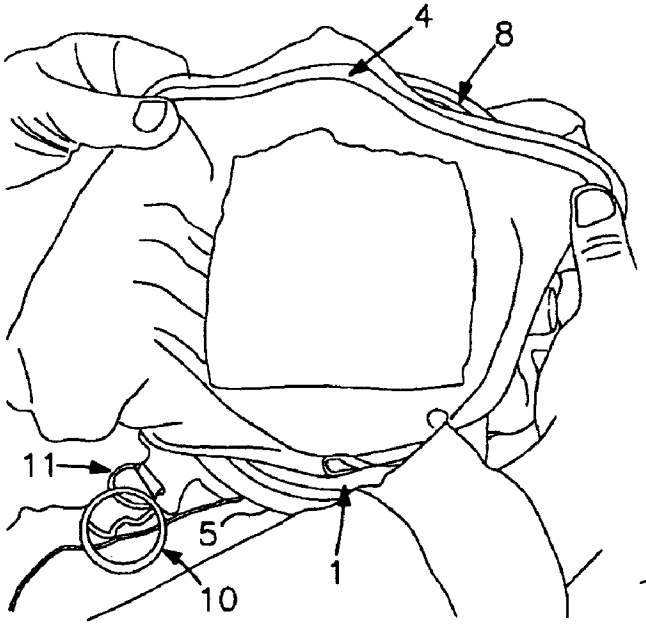
Figure 6:
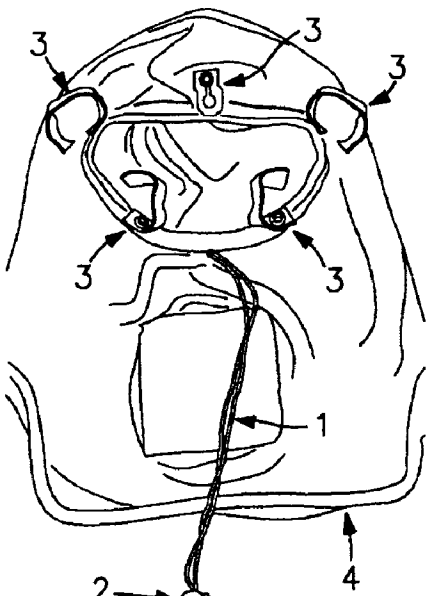

FIGS. 6–8 show another alternate design for packing an integrated hood.

FIG. 6 shows a cord 1 and facemask mounted circular split ring 10 and facemask mount D ring 11 and cord lock 2 fastened to an integrated hood 4 with fasteners 3 that are compatible and attachable to a facemask.

FIG. 7 shows the integrated hood 4 attached to the facemask 5 with the hood 4 pulled forward over the facemask 5, turning it inside out, thus covering the sight window 8 thus exposing the cord 1 and facemask mounted circular split ring 10 and facemask mounted D ring 11.

FIG. 8 shows the integrated hood 4 attached to the facemask 5 with the cord 1 disposed on the hood 4 with the cord lock 2 drawn tight completing the packing of the integrated hood.

Figure 11:
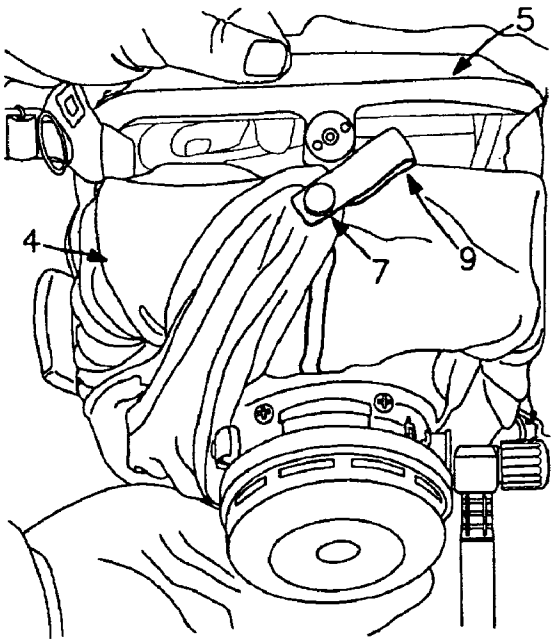
FIG. 11 is a perspective view of the integrated hood packed.
Figure 10:
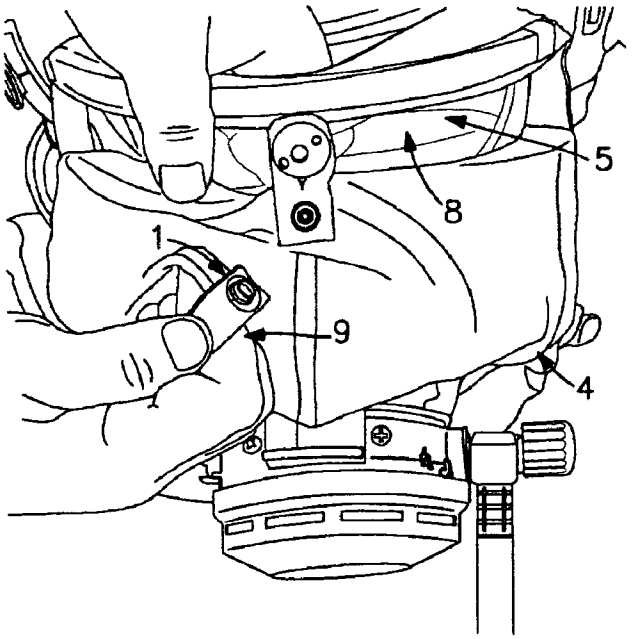
FIG. 10 is a perspective view of the integrated hood attached to a facemask and being rolled in preparation of packing the hood.
Figure 9:
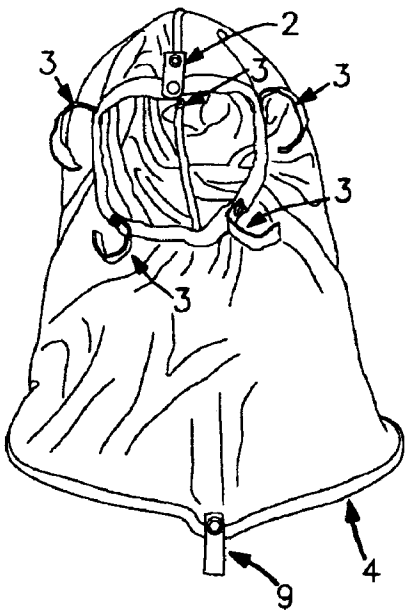
FIG. 9 is a perspective view of an integrated hood.

FIGS. 9–11 show an embodiment of the packing system of the present invention.

FIG. 9 shows a packing tab 9 fastened to an integrated hood 4 with fasteners 3 that are compatible and attachable to a facemask. The female snap socket 2 fastened to the hood 4.

FIG. 10 shows the integrated hood 4 attached to the facemask 5 with the hood 4 pulled forward over the facemask 5. The hood 4 is rolled in towards the sight window 8 exposing the female snap socket shown. The packing tab 9 is fastened to the hood 4 via the male snap stud 1.

FIG. 11 shows the integrated hood 4 attached to the facemask 5 with the male snap stud on packing tab 9 and the female snap socket fastened together 7 completing the packing of the integrated hood.

As should be apparent to one of ordinary skill in the art, it is within the scope of the present invention to include alternate types of fasteners for packing the hood, such as hook and loop, button and button hole, slide buckles, bayonet connections, pockets and zippers, ect., and any combination their of. Furthermore, it is with in the scope of the invention to position the packing system fasteners on the facemask, on the facemask and on the hood for the purpose of holding the integrated hood or non integrated hood packed on the facemask.

To don the packed integrated hood of the present invention, the person unsnaps the packing tap, dons the facemask directly onto the head and unrolls the hood into position. In conclusion, the present invention is a hood packing system positioned on a facemask that protects the hood from getting snagged or contaminated during the course of performing ones duties.

What is claimed is:

1. A hood packed and a facemask, the facemask for being in contact with the perimeter of the face with the first connector means secured to at least one portion of a hood and a second connector means secured to at least a second portion of the hood such that the first and second connector means are compatible.

2. A hood packed with a facemask, the facemask for being in contact with the perimeter of the face with a first connector means secured to at least one portion of the facemask and a second connector means secured to at least a second portion of the hood such that the first and second connector means are compatible.

3. An integrated hood and facemask, the hood with the packed facemask, the facemask for being in contact with the perimeter of the face with a first connector means secured to at least one portion of a hood and the second connector means secured to at least a second portion of the hood such that the first and second connector means are compatible.

4. An integrated hood and facemask, the hood with the packed facemask, the facemask for being in contact with the perimeter of the face with a first connector means secured to at least one portion of the facemask and a second connector means secured to at least a second portion of the hood such that the first and second connector means are compatible.

* * * * *